United States Patent [19]

Knorr

[11] 4,097,091

[45] Jun. 27, 1978

[54] METHOD AND APPARATUS FOR SECURING MINING MACHINES EMPLOYED ON INCLINED OR STEEP SEAMS

[75] Inventor: Volker Knorr, Sprockhovel, Germany

[73] Assignee: Gebr. Eickhoff Maschinenfabrik und Eisengiesserei m.b.H., Bochum, Germany

[21] Appl. No.: 799,400

[22] Filed: May 23, 1977

[30] Foreign Application Priority Data

May 19, 1976 Germany ..... 2622218

[51] Int. Cl.[2] ..... E21C 29/22

[52] U.S. Cl. ..... 299/1; 192/3 R; 299/43

[58] Field of Search ..... 299/1, 12; 192/1, 2, 192/3 R, 3 H, 3 N; 105/29 R

[56] References Cited

U.S. PATENT DOCUMENTS

| | | | |
|---|---|---|---|
| 3,885,487 | 5/1975 | Weston, Jr. | 192/3 N X |
| 4,045,083 | 8/1977 | Monks | 299/1 |

FOREIGN PATENT DOCUMENTS

| | | | |
|---|---|---|---|
| 1,235,838 | 3/1967 | Germany | 299/1 |
| 2,101,531 | 7/1971 | Germany | 299/1 |
| 427,146 | 2/1975 | U.S.S.R. | 299/1 |

*Primary Examiner*—Ernest R. Purser
*Assistant Examiner*—N. A. Nichols
*Attorney, Agent, or Firm*—Thomas H. Murray

[57] ABSTRACT

A method for securing mining machines, particularly longwall mining machines from sliding on inclined or steep seams in the event of a malfunction of a traction element or driving unit. The invention has particular application to longwall mining machines provided with at least two gearwheels which engage a rack extending along a working face whereby the mining machine may be advanced during a mining operation. The invention also relates to apparatus for automatically braking such a mining machine in the event of failure of a traction element.

9 Claims, 6 Drawing Figures

METHOD AND APPARATUS FOR SECURING MINING MACHINES EMPLOYED ON INCLINED OR STEEP SEAMS

BACKGROUND OF THE INVENTION

In one type of prior art longwall mining machine, skids are provided on opposite ends of the mining machine, each being provided with a driving gearwheel. The gearwheels, in turn, are driven by fluid motors connected in parallel to a winch pump. Due to the parallel connection of the fluid motors acting on the driving gearwheels, which are spatially separated from each other, the load is divided between the two driving gearwheels; and the desired large forward thrust can be produced even when one or both of the gearwheels does not completely mesh with the gear rack. A mining machine of this type is shown, for example, in copending application Ser. No. 738,573, filed Nov. 3, 1976.

Other prior art longwall mining machines are driven by means of two chain sprocket wheels, connected to a single drive motor, which engage a link chain stretched over the length of the face. The link chain, in effect, functions as a rack and is shown, for example, in U.S. Pat. No. 3,371,964.

Mining machines of this type which are employed in inclined or steep seams are always secured by a special braking device to prevent the machine from sliding in the event of a fracture of a traction element or malfunction of a driving element. These braking devices comprise either a separate safety rope which is constantly tensioned and maintained in the taut state by a take-up situated in the top of the mine roadway or they are formed by a braking device which acts on a guide rail for the mining machine and prevents it from sliding downward.

SUMMARY OF THE INVENTION

In accordance with the present invention, a system is provided for automatically braking a mining machine on a conveyor whenever there is a failure of one of a plurality of driving and/or traction elements for the machine which move it along the aforesaid conveyor.

In the ususal case, the driving elements comprise gearwheels which engage a rack extending along the machine conveyor. In the case where the gearwheels are driven by electric motors, separate tachometer generators are connected to the respective motors; and their outputs are applied to one or more comparator circuits, the arrangement being such that when the speed of one motor varies from that of the other, or others, the comparator will produce a signal which automatically disables all drive motors and actuates a brake which prevents movement of the mining machine along the conveyor. Thus, if any one of the motors should fail during a mining operation, or if one of the gearwheels should fracture, the speed difference between the drive motors disables all motors, acutates the aforesaid braking device, and prevents any further advance motion or any movement of the mining machine along an inclined conveyor.

In the case where the gearwheels or other driving elements are driven by fluid motors rather than electric motors, the input flow rates of the motors can be monitored, and any difference in input flow rates or changes in input flow rate quotient can be used to trigger an electrical circuit which disables the fluid motor and actuates the aforesaid braking device. Differences in the input flow rate of fluid motors of the same kind and size always indicate speed differences; while changes of the input flow rate quotient in fluid motors of different kinds or sizes indicate changes of the speed ratios of the fluid motors. In this way, any speed change of the individual motors can be detected, indicated and utilized for disabling the other drive motors and for actuating the braking device of the mining machine.

In another embodiment of the invention, two fluid motors are used to drive the gearwheels, these being driven by one or more fluid pumps. The fluid pump or pumps are connected to the fluid motors through a spool-valve arrangement in which fluid pressure, holding braking devices in released positions, persists until the pressure to one of the fluid motors rises above that of the other or until the ratio of the pressure inputs varies in the case of motors of different size. When this occurs, spool-valve elements within the valve change their relative positions to release the pressure on the braking devices and, consequently, cause the mining machine to come to a halt.

The above and other objects and features of the invention wil become apparent from the following detailed description taken in connection with the accompanying drawings which form a part of this specification, and in which.

Figure 1:
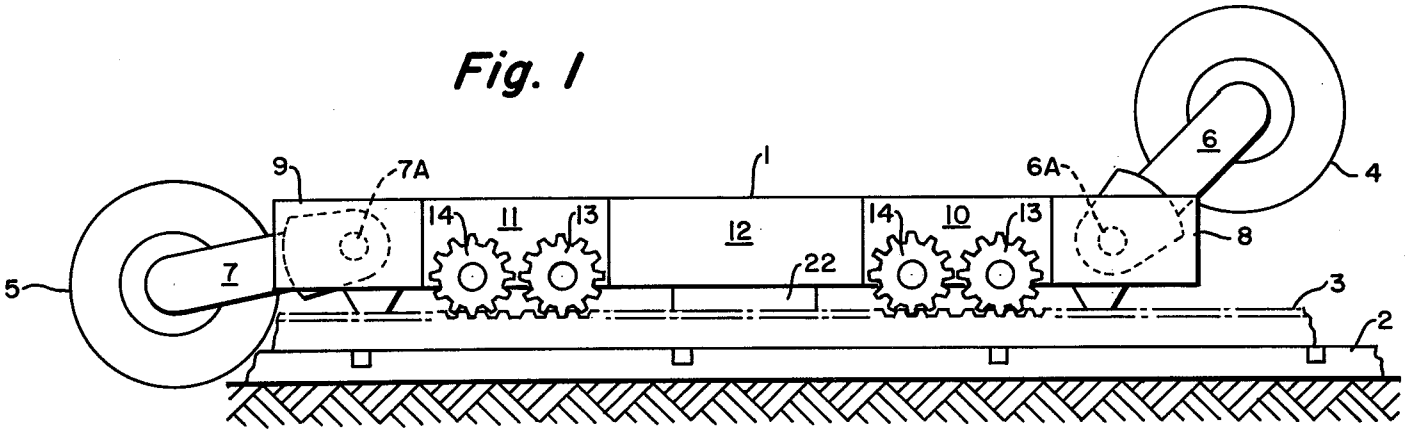
FIG. 1 is a schematic side view of a double-drum mining machine with which the present invention may be used.
Figure 2:
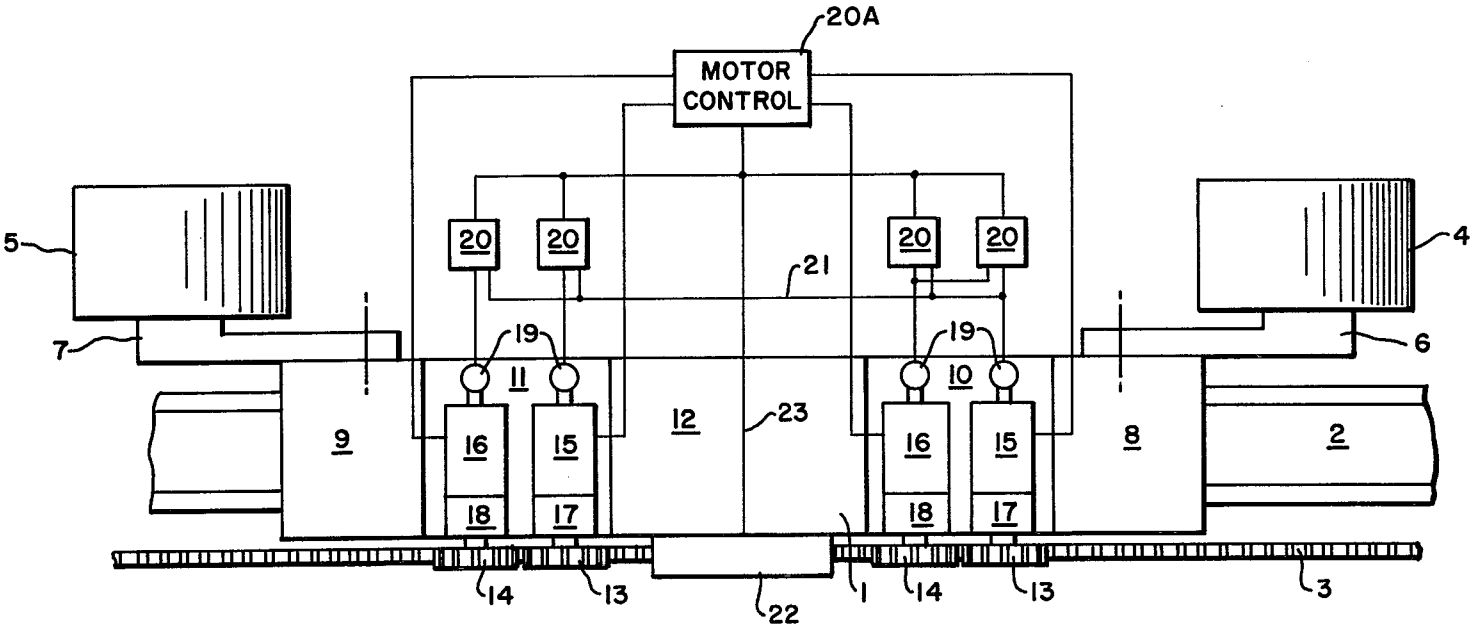
FIG. 2 is a top view of the mining machine of FIG. 1 which incorporates four gearwheels engaging a rack and four separate drive motors.

With reference to the drawings, and particularly to FIGS. 1 and 2, the longwall mining machine shown is designated by the reference numeral 1. Further details of the longwall mining machine itself can be seen by reference to U.S. Pat. Nos. 3,980,338, 3,968,754, 3,945,680 and 3,940,754, among others. The mining machine can traverse a face conveyor 2 (FIG. 2), the stowing side of which is provided with a rack 3 which extends over the length of the conveyor. The cutting drums 4 and 5 are retained in vertically-adjustable positions by means of support arms 6 and 7 which are mounted on the mining machine so as to pivot about shafts 6A and 7A associated with two cutter head driving units 8 and 9. Driving units adjoining the cutter head driving units 8 and 9 are indicated by the reference numerals 10 and 11. Between the driving units 10 and 11 is motor 12 which drives the two cutter drums 4 and 5 through units 8 and 9. The two units 10 and 11 drive gearwheels 13 and 14 which mesh with the teeth of rack 3 and move the mining machine 1 along the longitudinal extent of the face on the conveyor 2.

As best shown in FIG. 2, each driving unit 10 or 11 is provided with a set of two gearwheels 13 and 14, the gearwheels 13 being connected through transmissions 17 to electric motors 15 and the gearwheels 14 being connected through transmissions 18 to electric drive motors 16. Connected to the ends of the drive shaft of motors 15 and 16, opposite the gearwheels 14, 13, are tachometer generators 19 adapted to produce output analog signals having magnitudes proportional to the speeds of the respective drive motors. The outputs of the tachometer generators, in turn, are supplied to four comparators 20. The output of the tachometer connected to motor 15 of drive unit 10 is connected to the input of each of the comparators 20 for the other drive motors along with the signal from its own tachometer generator. The comparator 20 for motor 15 in drive unit 10 compares the output of its tachometer generator with that from the tachometer generator 19 in drive unit 10.

Under normal operation, the rotational speeds of the gearwheels 13, 14 and, therefore, the drive motors 15 and 16 will be the same. Analog signals all of the same magnitude are thus applied to all four comparators 20. A brake device 22 which is mounted on the frame of the mining machine 1 surrounds the rack 3. The brake 22 is connected through a conductor 23 to each of the individual comparators 20 and is actuated whenever any one of the comparators supplies an output signal. Such an output signal occurs if there are differences in the input signals which are applied to the comparators and, therefore, indicates that the rotational speeds of the associated motors 15 and 16 no longer correspond with each other. An output signal from any one of the comparators 20 activates the brake 22 as well as a motor control circuit 20A which disables all motors 15, 16 and, if desired, magnetically locks them. The mining machine 1 is then secured on the rack 3 and is protected against slipping on an inclined roadway.

Figure 3:
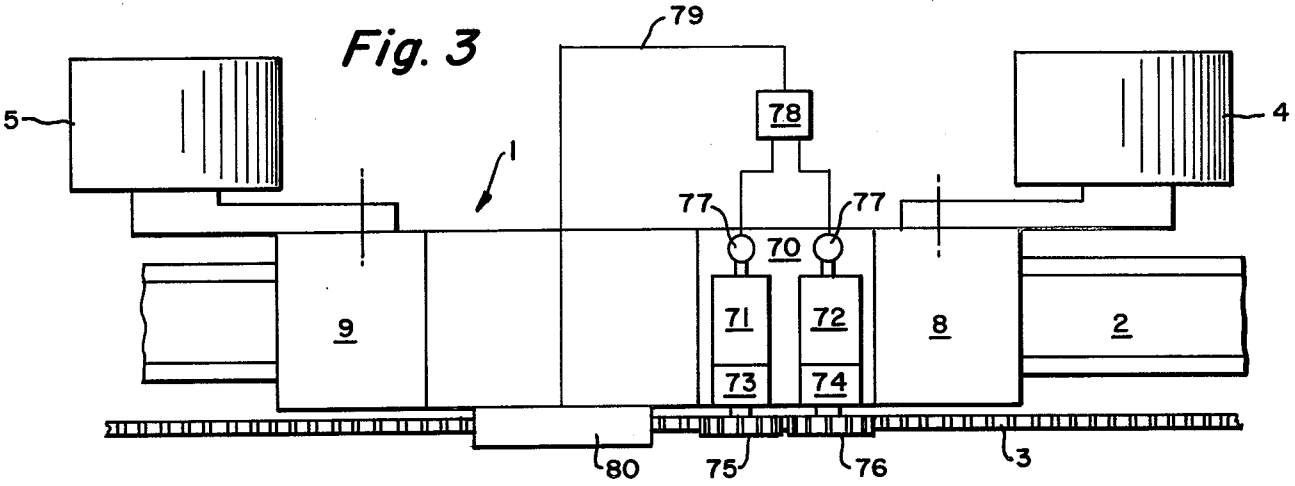
FIG. 3 is a top view similar to that of FIG. 2 but showing an embodiment of the invention which utilizes only two gearwheels and two electric driving motors.

In the embodiment of the invention shown in FIG. 3, the mining machine 1 is provided with only a single driving unit 70 which is provided with two electric motors 71 and 72 connected through transmissions 73 and 74 to the gearwheels 75 and 76 which engage the rack 3. In this case, two analog tachometer generators 77 form signals which are proportional to the respective motor speeds and are applied to each input of a common comparator 78. The output signal from the comparator 78, which occurs when there is a speed difference between the motors 71 and 72 is applied through conduit 79 to the braking device 80. Here, again, if there should be a difference in speed of the two motors 71 and 72 due to a fracture of one of the gearwheels 75 or 76, for example, the machine will be automatically shut down and the braking device 80 applied.

Figure 4:
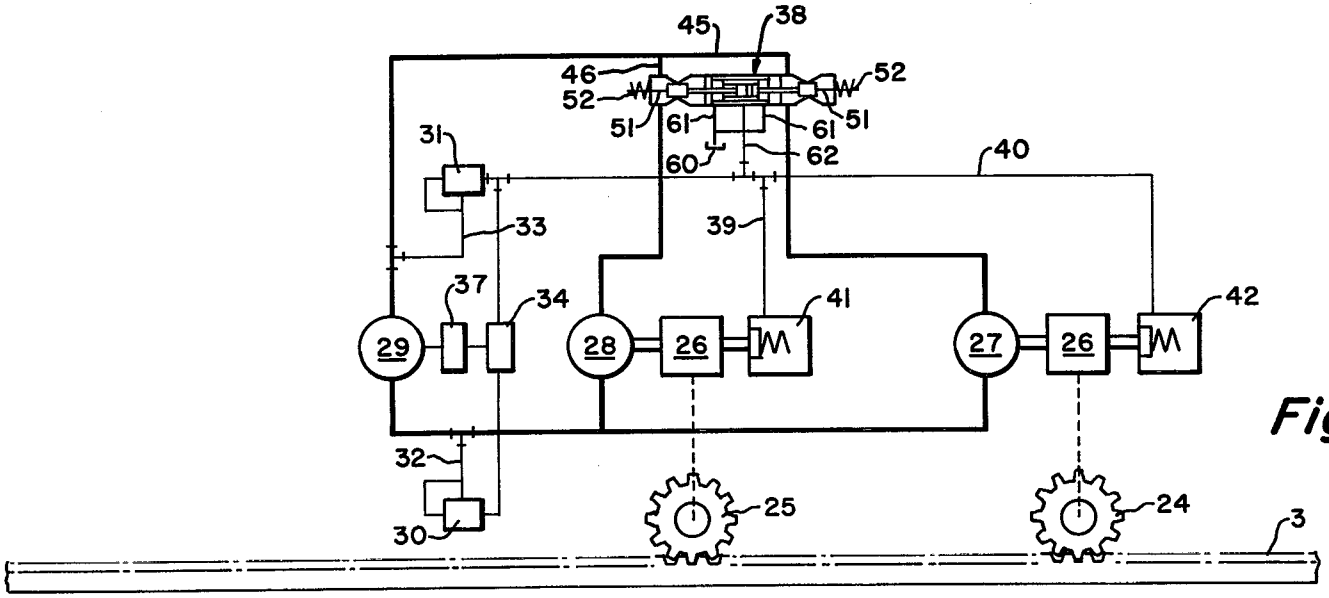
FIG. 4 is a schematic illustration of the drive system for a longwall mining machine, such as that shown in FIGS. 1–3, which incorporates fluid motors driven by a pump.
Figure 5:
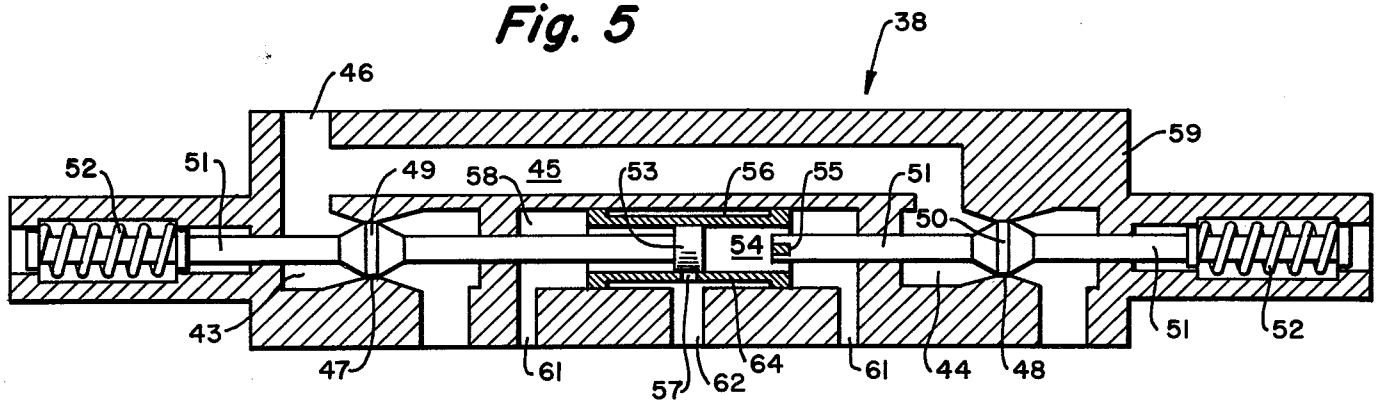
FIG. 5 is an enlarged cross-sectional view of one embodiment of the spool valve shown in FIG. 4.

The gearwheels of the mining machine can also be driven hydraulically as in the embodiment of the invention illustrated in FIGS. 4 and 5. In this case, the mining machine 1 engages the rack 3 by means of two gearwheels 24 and 25, each of which is driven by its own fluid motor 27 or 28 through transmissions 26. Normally, released braking devices 41 and 42 are connected to each of the transmissions 26 to brake the gearwheels 24 and 25 in the event of a speed difference as will hereinafter be explained.

Both of the fluid motors 27 and 28 are connected in parallel to a single fluid pump 29 in a closed hydraulic circuit. Two pressure control valves 30 and 31, each of which is connected through a duct 32 or 33 to opposite sides of the pump 29, respond to extreme pressure peaks to actuate shutdown valve 34 which, through pump control 37, returns the pump 29 to its idling position to relieve the excess pressure whenever an overpressure condition occurs.

A spool valve 38 in the hydraulic circuit for motors 27 and 28 is connected between the fluid pump 29 and the two fluid motors 27 and 28. Additionally, the spool valve 38 is connected through conduits 39 and 40 to the brake devices 41 and 42 for transmissions 26. As will be hereinafter explained, the two brake devices 41 and 42 are normally held in released position by the pressure within the conduits 39 and 40. If, however, the pressure within the conduits 39 and 40 drops, the brakes 41 and 42 will be actuated to brake the transmissions 26, and hence, the gearwheels 24 and 25.

The actual construction of the valve 38 is illustrated in FIG. 5. Passageways 43 and 44 supply fluid under pressure to the motors 27 and 28 from pump 29 via port 46. Alternatively, when the direction of rotation of the motors 27 and 28 is reversed, fluid expelled from the motors is returned to the pump through passageways 43 and 44 and the port 46. In the embodiment of the invention shown in FIGS. 4 and 5, the two passageways 43 and 44 are interconnected by a passageway 45 and merge into the common port 46. Each passageway 43 and 44 has a constricted portion 47 or 48 which is closed by a frusto-conical spool-valve element 49 or 50. Each spool-valve element 49 or 50 is connected through a spool rod 51 to an enlarged diameter end engaging a spring 52 which resists movement of its spool-valve element 49 or 50 away from the constricted portion 47 or 48. The other end of the spool rod 51 for spool-valve element 49 is secured to a piston 53 slideable within a sleeve 64. The sleeve 64, which is slideable within a cylindrical bore 58, is connected through cross member 55 to the end of the spool rod 51 for valve element 50 opposite its spring 52. It will be appreciated, therefore, that the sleeve 64 can slide within the bore 58 independently of the piston 53 and vice versa.

The outer periphery of the sleeve 64 is provided with an intermediate recessed portion 56 which communicates with a bore or port 57 in the side wall of the sleeve 64. The port 57 will normally be closed by the piston 53 within the sleeve 64. Opposite ends of the cylindrical bore 58 are connected through ports 61 to a sump 60 (FIG. 4); while the recessed portion 56 surrounding the sleeve 64 is connected through port 62 to conduits 39 and 40 connected to the brakes 41 and 42.

With the mining machine traveling in one direction, fluid under pressure from the pump 29 will flow through port 46, causing the spool-valve elements 49 and 50 to move to the right as viewed in FIG. 5 against the force of springs 52. Assuming that both motors 27 and 28 are rotating at the same speed, the movement of the spool-valve element 49 will be equal to that of valve element 50 with the result that both the sleeve 64 and the piston 53 move to the right also, maintaining the port 57 closed. On the other hand, if the direction of movement of the mining machine is reversed, fluid exhausted from the fluid motors 27 and 28 will flow in the reverse direction, causing the spool-valve elements 49 and 50 to both move to the left. Here, again, the port or bore 57 remains closed, provided that both motors 27 and 28 are rotating at the same speed such that their output pressures are essentially the same.

When, however, there is a failure of one of the two motors 27 or 28, one of transmissions 26 or one of the gearwheels 24 or 25, the two motors 27 and 28 will no longer rotate at the same speed. Consequently, the pressure exerted on the two spool-valve elements 49 and 50 will no longer be the same, and relative movement will occur between the sleeve 64 and the piston 53, thereby exposing the port 57 and connecting conduits 38 and 40, connected to the braking devices 41 and 42, to the sump 60 through port 61. Consequently, both braking devices 41 and 42 are no longer held in open position and are released to brake the transmissions 26 as well as the gearwheels 24 and 25.

Figure 6:
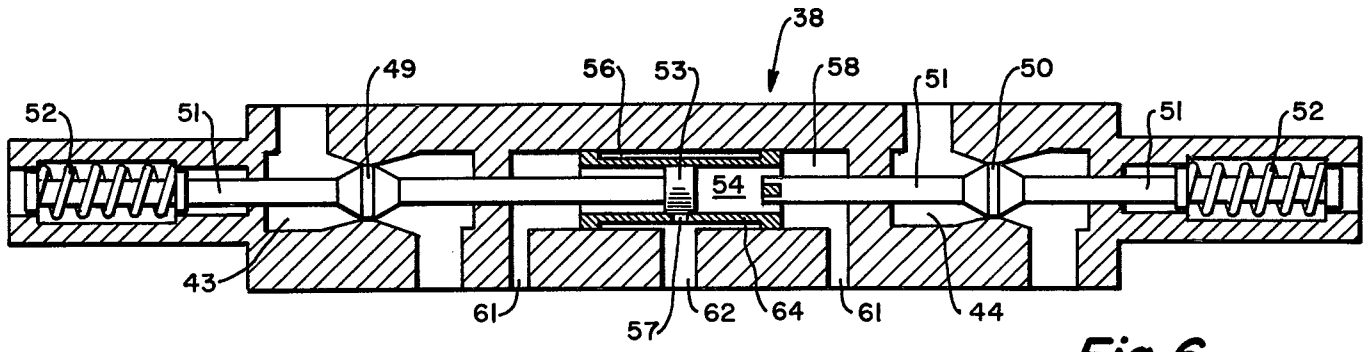
FIG. 6 is an enlarged cross-sectional view of another embodiment of the spool-valve arrangement shown in FIG. 4.

An alternative embodiment of the invention is shown in FIG. 6 wherein elements correponding to those of FIG. 5 are identified by like rference numerals. In this case, however, the two passageways 43 and 44 are completely separated rather than being interconnected as in FIG. 5. The embodiment of FIG. 6, therefore, is particularly suitable for a mining machine in which each of the two gearwhels 24 and 25 is driven by a separate fluid motor having its own fluid pump. In this case, the two fluid pumps can have different delivery rates or the two fluid motors can be designed so that they can operate with a different input flow rate. In the case of different flow rates, the diameters of the spool-valve elements 49 and 50 are adjusted such that relative movement is produced between the sleeve 64 and piston 53 only if the ratio of the input flow rates of the two fluid motors or the ratio of the delivery rates of the two fluid pumps is altered. If a change occurs, therefore, relative movement will occur between the sleeve 64 and piston 53 to release the brakes 41 and 42. The piston 53 can be detachably connected to the spool rod 51 in the embodiment of either FIG. 5 or FIG. 6 and can be replaced by a piston of different length, thereby altering the sensitivity of the valve 38. That is, a longer piston will reduce the sensitivity of the valve since a greater amount of relative movement must then occur between the sleeve 64 and the piston 53 in order to expose the port 57. It is also possible to utilize the pressure of the main hydraulic circuit between the pump 29 and the motors 27 and 28 instead of a separate control circuit in order to release the two brakes 41 and 42. In this case, the main circuit will then be connected to port 62. The main circuit pressure will then drop suddenly in the event of relative pressure between the elements 64 and 53, releasing the brakes 41 and 42.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A method for automatically braking a mining machine movable along a conveyor by means of a plurality of gearwheels which engage a rack extending along the conveyor and are driven by separate motors on the mining machine; which comprises measuring the rotational speeds of the motors, comparing said rotational speeds, and actuating a brake device to stop movement of the mining machine when the ratio of the speeds of the motors varies.

2. The method of claim 1 wherein both of said motors normally operate at the same speed and wherein said brake device is actuated whenever the speeds of the motors are different.

3. The method of claim 1 wherein said separate motors comprise fluid motors and wherein the input flow rates of the fluid motors are measured and any differences of input flow rate or changes in input flow rate quotient actuate the brake device to stop movement of the mining machine.

4. The method of claim 1 wherein electrical signals proportional to the speeds of the respective motors are produced, said electrical signals being compared in a comparator circuit to produce an output signal for actuating said brake device when the ratio of the magnitudes of the first-mentioned electrical signals varies.

5. In apparatus for automatically braking a mining machine movable along a conveyor by means of a plurality of gearwheels which engage a rack extending along the conveyor, the combination of separated drive motors for each of said gearwheels, means for measuring the rotational speeds of the motors, means for comparing said rotational speeds, and apparatus for actuating a brake device to stop movement of the mining machine when the ratio of the compared speeds of the motors varies.

6. The combination of claim 5 including tachometer generators connected to each of said separate drive motors, a comparator circuit for comparing the outputs of said tachometer generators, and electrical circuit means for actuating said brake device when the ratio of said electrical signals varies.

7. The combination of claim 5 wherein said separate drive motors comprise two fluid motors driven by a common fluid pump, the fluid motors being connected to the common pump through a balanced spool-valve arrangement which will become unbalanced to actuate said brake device when the pressure of the fluid supplied to the two motor varies.

8. The combination of claim 7 wherein said spool valve comprises spool-valve elements interposed between said pump and said motors whereby the spool-valve elements will move in equal increments when the input pressures to the two fluid motors are the same, and relatively movable valve elements connected to said spool-valve elements intermediate the same, said relatively movable valve elements moving in unison until a pressure differential at the inputs to said fluid motors exists, whereupon relative movement occurs between said slideable valve elements to actuate said brake device.

9. The combination of claim 8 wherein said brake devices comprise fluid-actuated brakes normally held in released position by fluid under pressure, and wherein said relatively movable valve elements release the pressures to said brake devices to apply the same and secure the mining machine upon relative movement between the two.

* * * * *